United States Patent [19]

Steeger

[11] Patent Number: 4,508,940

[45] Date of Patent: Apr. 2, 1985

[54] DEVICE FOR THE COMPENSATION OF HEARING IMPAIRMENTS

[75] Inventor: Gerhard Steeger, Erlangen, Fed. Rep. of Germany

[73] Assignee: Siemens Aktiengesellschaft, Berlin & Munich, Fed. Rep. of Germany

[21] Appl. No.: 400,413

[22] Filed: Jul. 21, 1982

[30] Foreign Application Priority Data

Aug. 6, 1981 [DE] Fed. Rep. of Germany ..... 3131193

[51] Int. Cl.[3] ..... H04K 25/00

[52] U.S. Cl. ..... 179/107 FD; 179/107 R; 381/101; 381/104; 381/106; 381/109

[58] Field of Search ..... 179/107 FD, 107 R, 1 D, 179/1 P, 1 N, 1 SA, 1 SD; 330/126; 381/68, 69, 71, 72, 98–109, 94; 73/585

[56] References Cited

U.S. PATENT DOCUMENTS

| | | | |
|---|---|---|---|
| 3,784,750 | 1/1974 | Stearns et al. | 179/1 N |
| 3,818,149 | 6/1974 | Stearns et al. | 179/107 FD |
| 3,846,719 | 11/1974 | Dolby | 179/1 P |
| 3,848,091 | 11/1974 | Stearns et al. | 179/107 FD |
| 3,894,195 | 7/1975 | Kryter | 179/107 FD |
| 3,927,279 | 12/1975 | Nakamura et al. | 179/107 FD |
| 4,025,721 | 5/1977 | Graupe et al. | 179/1 P |
| 4,052,571 | 10/1977 | Gregory et al. | 179/107 FD |
| 4,061,875 | 12/1977 | Freifeld et al. | 381/72 |
| 4,119,812 | 10/1978 | Fox | 179/1 P |
| 4,156,116 | 5/1979 | Yanick | 179/107 R |
| 4,185,168 | 1/1980 | Graupe et al. | 179/1 P |
| 4,187,413 | 2/1980 | Moser | 179/107 |
| 4,188,667 | 2/1980 | Graupe et al. | 179/107 FD |
| 4,266,094 | 5/1981 | Abend | 179/1 D |
| 4,290,034 | 9/1981 | Fraser | 333/173 |

FOREIGN PATENT DOCUMENTS

| | | | |
|---|---|---|---|
| 0064042 | 4/1982 | European Pat. Off. . | |
| 2502536 | 7/1976 | Fed. Rep. of Germany | 179/1 P |
| 2707607 | 9/1977 | Fed. Rep. of Germany . | |

OTHER PUBLICATIONS

IEEE Transactions on Audio and Electro Acoustics, vol. 1, Au-18, No. 2, Jun. 1970, Proakis, "Adaptive Digital Filters for Equalization of Telephone Channels, pp. 195–200.

IEEE Journal of Solid-State Circuits, vol. SC-12, No. 6, Dec. 1977, Caves et al., "Sampled Analog Filtering Using Switched Capacitors as Resistor Equivalents", pp. 592–599.

IEEE Journal of Solid-State Circuits, vol. SC-12, No. 6, Dec. 1977, Hosticka, "MOS Sampled Data Recursive Filters Using Switched Capacitor Integrators", pp. 600–608.

Radio Amal. Journal, vol. 34, No. 10, Oct. 1978, Schultz, "An Optimum Speech Filter", p. 22.

Electronics, Feb. 15, 1979, Jacobs et al., "Technical Article: Touch-Tone Decoder Chip Mates Analog Filters with Digital Logic", pp. 105–111.

(List continued on next page.)

*Primary Examiner*—Gene Z. Rubinson
*Assistant Examiner*—Danita R. Byrd
*Attorney, Agent, or Firm*—Hill, Van Santen, Steadman & Simpson

[57] ABSTRACT

An exemplary embodiment includes a plurality of parallel signal channels coupled with a signal input transducer, such as a microphone or induction coil. Each of the signal channels includes a respective bandpass filter for selection of a different frequency band, a controlled-gain amplifier, controlled by a volume control potentiometer, circuits for non-linear signal processing, and a bandpass filter for the reduction of distortion components caused by the non-linear processing circuits. A summing amplifier combines the signal components from all channels and is connected via an amplifier to an output signal transducer. Space requirements and power consumption are reduced in such a multi-channel processing arrangement by implementing all of the filters as sampled-data analog circuits. As a result hearing aids are provided which can be worn on the head, e.g. behind the ear.

9 Claims, 1 Drawing Figure

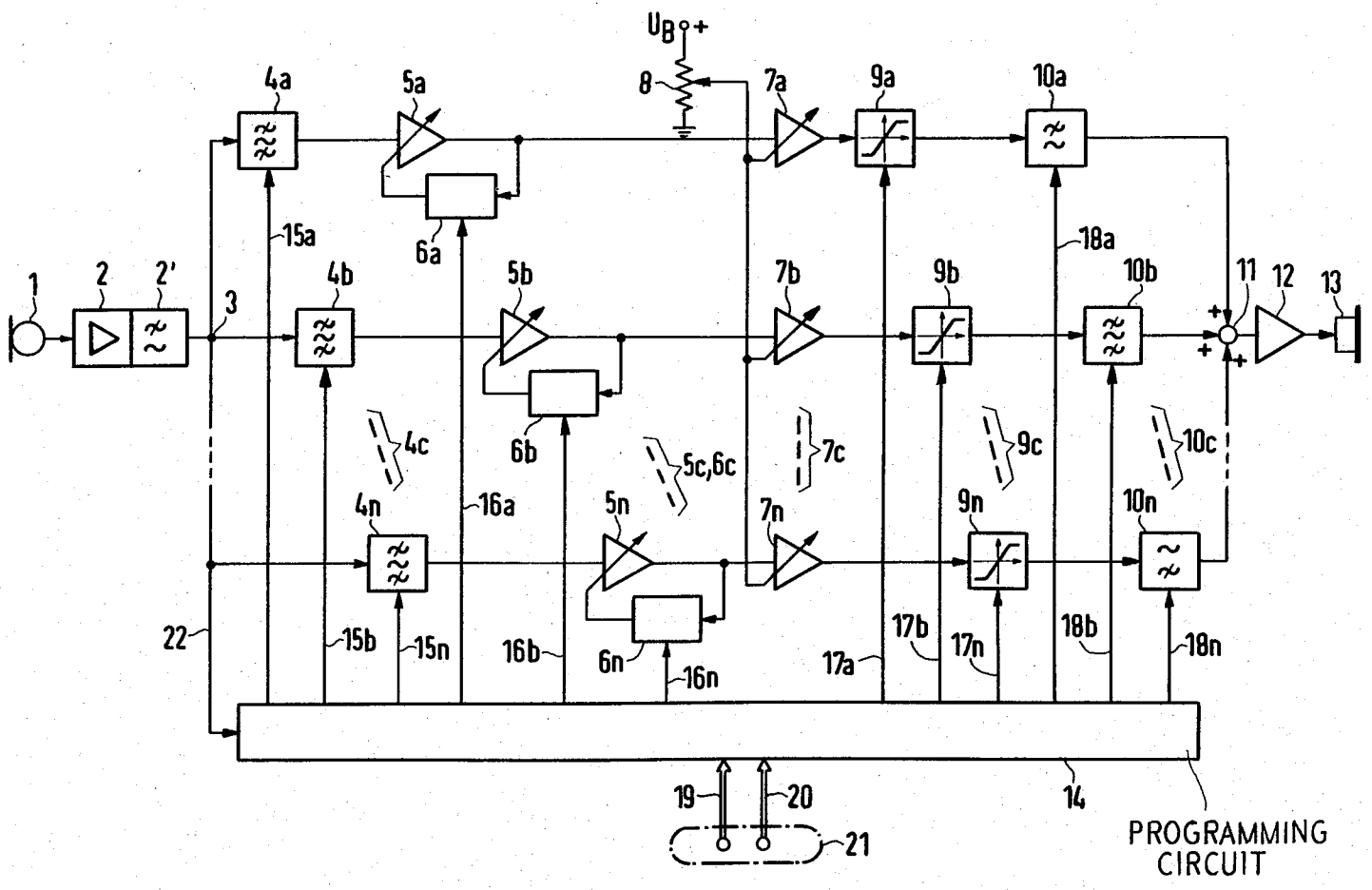
PROGRAMMING CIRCUIT
$U_B$
θ
1
2
2'
3
4a
4b
4c
4n
5a
5b
5c,6c
5n
6a
6b
6n
7a
7b
7c
7n
9a
9b
9c
9n
10a
10b
10c
10n
11
12
13
14
15a
15b
15n
16a
16b
16n
17a
17b
17n
18a
18b
18n
19
20
21
22

DEVICE FOR THE COMPENSATION OF HEARING IMPAIRMENTS

BACKGROUND OF THE INVENTION

The invention relates to a device for the compensation of hearing impairments. Devices of this type are disclosed, for example, in Scand. Audiol. 8:121–126, 1979, as "Programmable Hearing Aid With Multi-Channel Compression" by S. Mangold and A. Leijon (cf., in particular, page 121, right column, last paragraph up to and including page 122, right column, paragraph 4).

In the known device, the electrical input signal which is generated, for instance, in a microphone or in an induction pick-up coil, is supplied to a plurality of filters which respectively allow adjacent frequency bands of the input frequency range to pass.

The individual frequency bands derived from the input signal are then transmitted via parallel signal channels having non-linear signal processing circuits such as compression circuits for compressing the dynamic range, and amplitude attenuation circuits. Finally the signal components from the respective parallel signal channels are combined into a resultant signal and supplied to the ear of a hearing impaired person via an output transducer. The parameters for the filters, the dynamic range compression circuits and the amplitude attenuation circuits may be supplied from a digital memory which has been programmed based on data concerning an individual's hearing impairment. For example, the data may be obtained from an audiometer and supplied to a data input of the hearing aid.

Although the analog signal processing realized in the known device represents a fundamentally simple method and corresponds to the technology hitherto employed in hearing aid technology, the following disadvantages derive in the realization of the apparatus:

(1) If the hearing aid is also to be able to compensate for serious hearing impairments (for example great loss of high tones), then filter circuits are necessary which require a great deal of space and power, so that incorporation in behind-the-ear devices is made more difficult.

(2) Precision and temperature stability problems in the resistors and capacitors results, particularly when the filters are to be realized in integrated circuit technology.

(3) The setting of the filter characteristic with the variation range and precision necessary for a universally employable hearing aid requires very involved circuits (for example digital-to-analog converters and analog multipliers).

The disadvantages cited under (2) and (3) are avoided when the signal processing is carried out completely digitally, i.e. time-discrete and amplitude-quantized. Such a hearing aid functioning with integrated logic circuits is known from U.S. Pat. No. 4,187,413. Because of the outlay for the analog-to-digital converter at the input and the digital-to-analog converter at the output, the difficulties cited above under (1) remain. In particular, the high power consumption of such circuits can only be accommodated with difficulty from the batteries employable in the installation space already limited by the circuit in behind-the-ear devices.

SUMMARY OF THE INVENTION

The object of the invention is to specify a hearing aid configuration for the compensation of hearing impairments which, taking account of space requirements and power consumption, enables a multi-channel processing of the input signal in hearing aids to be worn on the head, e.g. behind the ear said multi-channel processing being controllable from a memory.

Complicated circuits are avoided by employing filters functioning time-discrete and amplitude-analog, so that an implementation having the size of commercially standard pocket hearing aids or behind-the-ear hearing aids is significantly facilitated. This is possible with the integrated filter circuits functioning time-discrete which have become known in the meantime, said filter circuits exhibiting all the advantages of pure digital filters which are significant for hearing aid uses but which, because of the analog representation of the state variables, no longer require analog-to-digital and digital-to-analog analog converters. Switched capacitor filters (SCF), bucket brigade filters ("bucket brigade devices"-BBD) and filters with charge-coupled memories ("charge coupled devices"-CCD) are preferably utilized for implementing the time discrete (sampled data) analog filters. The possibility therewith derives of equipping small pocket hearing aids and behind-the-ear hearing aids with time-discrete filters. Because the said filters can also be constructed in such a manner that their coefficients can be very quickly altered by means of digital control signals, it becomes possible according to the invention to carry out a multi-channel, adaptive optimum filtration in the hearing aid. At the same time, this also enables the designational reduction of environmental noise as described in greater detail, for instance, in U.S. Pat. No. 4,025,721.

The output signals of time-discrete filters functioning amplitude-analog and of digital-to-analog converters exist in the form of a stepped curve. This means that their spectrum contains repetitions of a signal spectrum given multiples of the sampling frequency (known, for example, form A. B. Carlson, Communication Systems, McGraw Hill, New York, 1968, Section 7.1 through 7.2, pages 272 through 289). When parts of said repetition spectra fall into the audible frequency range, then they become audible as distortions. Therefore, these repetition spectra are usually suppressed by means of an analog low-pass filter (a so-called "smoothing filter").

It has proven particularly expedient to select the clock frequency of the time-discrete filters higher than the sum of the upper cut-off frequency of audibility and the cut-off frequency of the input amplifier, because the said repetition spectra then lies entirely above the audible frequency range. What is thereby to be understood as the cut-off frequency is that frequency at which response is below a limiting value (for example −60 dB). Thus, the said distortions become no longer audible in a simple manner and no so-called smoothing filter is required.

The employed time-discrete filters have the advantage that they can be manufactured as integrated circuits both in thick film as well as thin film technology and can also be manufactured in monolithic integration technology. As a result, highly complex circuits can be realized in a small space. The time-discrete manner of functioning has the advantage that the known problems of integrated analog circuits concerning stability and temperature behavior are largely avoidable and, thus, the inclusion in the circuit of discrete components often necessary for the stabilization of the integrated circuits can be avoided as well. Special switched capacitor filters can be integrated in a particularly advantageous manner in complementary metal-oxide-silicon (CMOS) technology into circuits which are characterized by low space requirements, highest possible time and temperature constancy, as well as very low supply voltages and currents.

The invention comprehends multi-channel hearing aids of any number of channels, i.e. aids with, in general, n parallel frequency-selective filters whose transmission ranges at most slightly overlap at the marginal edges of the frequency response, whereby $n \geqq 2$ is selected. In view of the intended, optimum compensation of as many practically occurring hearing impairments as possible, a desirable upper limit of the channel number n given the present state of perception, is the number of frequency groups ("critical bands") of hearing, which is specified at twenty-four (according to E. Zwicker, "Scaling", in: W. D. Keidel and W. D. Neff, Editors, *Handbook of Sensory Physiology,* Volume V, part 2, Springer-Verlag, Berlin 1975, Section III.A, pages 409 through 414).

Such large numbers of channels are presently not yet realizable because of the space and power requirements of the necessary circuit elements. It has been shown, however, that three-channel devices already allow a significantly better matching than conventional hearing aids when the pass bands of the filters coincide with those frequency bands which are assumed on average by the most important formants. Thus, the first range would lie between the lower frequency limit of the sound transducers (approximately 50 Hz) and approximately 600 Hz; the second would lie between approximately 600 Hz and approximately 2.5 kHz; and the third would lie between approximately 2.5 kHz and the upper limit fixed by the sound transducers (presently 8 through 10 kHz). Given such devices, the hearing impairment can already be compensated with sufficient precision in a great number of instances; moreover, strong low-frequency noise signals (for example traffic or machine noises) no longer have an unfavorable influence on the gain control in the higher frequency channels, i.e. particularly at approximately 1 through approximately 8 kHz, which are particularly significant for speech comprehension.

It has proven expedient to provide only one volume adjuster whose output signal influences the gain of respectively one signal amplifier in one respective subchannel. Therewith, the incorporation of multiple potentiometers can be avoided, these being problematical in terms of their space requirement and their synchronization. Simultaneously, an individual control characteristic fixed by the type of pre-setting of the respective amplifier can be thus realized in each channel.

It has proven of further advantage to effect—before or after the additive combination of the sub-signals—an elimination of distortion components from the sub-signals or from the sum signal, said distortion components deriving from the non-linear signal distortion due to the automatic gain control (AGC) and the peak clipping (PC). Low-pass filters or band-pass filters whose frequency responses are approximated to those of the above-described filters for channel separation can be employed for this purpose. Depending upon the degree of required noise elimination, simple passive RC filters, integrated active RC circuits or, again, time-discrete filters can be employed.

The employment of time-discrete filters makes it possible to achieve the change of the filter characteristics (frequency limits and gains) in a simple manner over a wide range of adjustment. This expediently occurs in that the setting parameters are digitally coded in an external device, most advantageously already in the audiometer, and are transmitted to the hearing aid either serially over a double line or in parallel over a plurality of lines. These data are stored in a programming circuit which derives setting signals therefrom in a fundamentally known manner above publication by Mangold and Leijon; U.S. Pat. No. 4,187,413) and supplies them to the filters. As likewise fundamentally known, it proves expedient to also set the parameters of the gain control and peak value limitation circuits (for example primary amplification, control onset, static and dynamic characteristic curve) by means of further data transmitted to the programming circuit.

The parameter memory of the programming circuit is expediently erasably designed, executed, for example, in the manner of a programmable read only memory which can be erased by means of ultraviolet light or, respectively, electrical voltage (erasable programmable read-only memory (EPROM) or, respectively, electrically alterable read-only-memory (EAROM)). It is thereby possible to alter the hearing aid data permanently programmed for a longer time span at a later point in time, for example on the occasion of a further audiometric examination of the hearing aid wearer and in accord with the change of the hearing impairment which has occurred in the meantime.

An augmentation of the programming circuit which has proven expedient in many cases can be obtained in that, in addition to the storage of prescribed base data, a continuous change of the hearing aid data dependent on the input signal is enabled by the programming circuit itself, for example by means of realizing said circuit by means of a microcomputer circuit. By so doing, an adaptive noise signal suppression becomes possible by means of optimum filtration, as is known from the U.S. Pat. No. 4,025,721. As a result of the invention, however, the principle only realized there in a single channel can be expanded to a multi-channel optimum filtration in all frequency channels.

Further details and advantages of the invention are explained in greater detail below on the basis of the exemplary embodiment illustrated in the FIGURE on the accompanying drawing sheet; and other objects, features and advantages will be apparent from this detailed disclosure and from the appended claims.

BRIEF DESCRIPTION OF THE DRAWING

The single FIGURE shows a schematic block diagram of an inventive hearing aid equipped with filters.

DETAILED DESCRIPTION

In the illustrated device, a microphone 1 is provided as the input transducer, said microphone 1 being connected to a pre-amplifier 2 which, as indicated by 2' exhibits a low-pass frequency response. The signal amplified in that manner is then divided at a point 3 and supplied to a plurality of time-discrete frequency filters **4*a* through 4*n*, i.e., a total of n time-discrete frequency filters. Of these, that referenced with 4*a* is a band pass which transmits frequencies from 50 Hz through 600 Hz. The filter 4*b* likewise connected at the point 3 is a band pass which is effective at frequencies from 0.6 kHz to 2.5 kHz. Given a reduced frequency scope of the filters 4*a* and 4*b*, even more filters can be provided, as indicated by means of points 4*c*. Finally, the filter 4*n*** follows as the last, said filter being effective at 2.5 kHz through approximately 8 kHz given the frequency distribution specified for 4*a* and 4*b*.

Variable amplifiers 5*a* through 5*n* then follow the filters, said variable amplifiers 5*a* through 5*n*, together with the controlling means 6*a* through 6*n* realizing a gain control in a fundamentally known manner. The disposition of further variable-gain amplifiers is again indicated here with 5*c* and that of controlling means is indicated with 6*c*. Accordingly, the signals proceed to variable amplifiers 7*a* through 7*n* which, controlled by the output voltage of the volume control 8, undertake the volume setting.

Subsequently, the signals are subjected to a peak value limitation in the non-linear elements 9*a* through 9*n* in a known manner. Signal distortions thereby caused are reduced by post-filtration with filters 10*a* through 10*n* which, for example, can correspond to the filters 4*a* through 4*n* in their frequency response. A possibility of augmentation by means of further channels is likewise indicated with 7*c*, 9*c* and 10*c*, given the variable-gain amplifiers 7*a* through 7*n*, the limiters 9*a* through 9*n* and the distortion-reducing filters 10*a* through 10*n*.

The signals treated in such manner are finally additively recombined at a point 11 and are supplied via a final amplifier 12 to an earphone 13 as the output transducer.

The setting of the filters 4*a* through 4*n*, controlling means 6*a* through 6*n*, and peak value limiters 9*a* through 9*n* is carried out by means of a programming circuit 14. The filters 4*a* through 4*n* receive their control signals over the lines 15*a* through 15*n*; the analogous case applies for the controlling means 6*a* through 6*n* over the lines 16*a* through 16*n*, over the lines 17*a* through 17*n* for the limiters 9*a* through 9*n*, and, finally, over the lines 18*a* through 18*n* for the filters 10*a* through 10*n*.

For its part, the programming circuit 14 receives the setting data from an external device (for example from an audiometer) over one or more data lines 19, whereby the transmission and the storage in the programming circuit 14 is controlled over a plurality of control lines 20 proceeding from the external device. The connection to the latter is provided by means of a plug-type connection 21. When the programming circuit 14 is realized by means of a microcomputer circuit, then it can entirely or partially calculate the setting parameters itself as a function of the momentarily existing input signal which is supplied to it for this purpose over the line 22.

The manner of functioning of the device is such that the electrical signal generated in the input signal transducer, i.e. in the microphone 1 or, respectively, in an induction pick-up coil for electromagnetic oscillations replacing it, is boosted in the amplifier 2 to such a voltage level that it is easily accessible to the following signal processing. The low-pass frequency response 2' obtained in the amplifier 2 prevents signal components and, under certain conditions, in-coupled noise signals which lie above half the sampling frequency from being folded-over back into the audible frequency range, given the sampling operation to be carried out in the time-discrete filters 4*a* through 4*n*.

Subsequently, the signal is sampled in the filters 4*a* through 4*n* and is respectively suppressed frequency-selective to such a degree that the respective parts of the signal belonging to the specified frequency ranges can be separately treated. Thus, a gain control dependent on the input or output level is achieved in the variable-gain amplifiers 5*a* through 5*n* which are controlled over the controlling means 6*a* through 6*n*, whereby different, known control principles can be applied, for example, the standard AGC circuits employing the short-term mean value of said levels but also the momentary value compressors as are specified by Keidel and Spreng in the German AS No. 15 12 720. As a result, a high degree of compensation of for dynamic auditory disruptions (for example loudness recruitment) is made possible.

By means of the control 8 and the variable-gain amplifiers 7*a* through 7*n* driven by said control 8, the hearing aid wearer has the possibility of bringing the volume of the output signal into a volume range which he finds comfortable. A desired non-linear signal deformation can fundamentally be achieved with the non-linear circuits 9*a* through 9*n*. In the normal case, a peak value limitation is undertaken in a known manner and, thus, the occurrence of unpleasant or even hearing-jeopardizing peak values of the output acoustic pressure level is prevented.

The distortion components caused by these non-linearities are reduced in the filters 10*a* through 10*n*; but the useful signals are left uninfluenced to the largest degree possible. The filters 10*a* through 10*n* can be eliminated when the noise-component suppression by the low-pass properties of the final amplifier 12 and the ear piece 13 is sufficient. After the combination of the sub-signals at the addition point 11, the further treatment of the sub-signal ensues in the standard manner, i.e. it is brought to the intensity necessary for the operation of the output transducer, i.e. of the earphone 13 in the present case, in the amplifier 12. A signal then appears at the earphone 13 which is suitable for the compensation of the respectively existing hearing impairment.

Given a hearing impairment wherein, for example, it is primarily the hearing ability for high frequencies which is vitiated and wherein, moreover, auditory recruitment essentially only occurs in this range, the (unregulated) base amplification of the frequency channels at the amplifiers 5*a* through 5*n* is to be respectively set in a known manner and in such manner that the pathological auditory threshold curve of the patient is compensated overall in the best possible manner on average. The controlling means 6*a* through 6*n* are now to be set in such manner that the dynamic loss in the respective frequency band is compensated as well as possible, i.e., given high levels, the controlling means 6*n* will effect the noticeable gain reduction in the highest frequency channel, whereas the controlling means 6*a* remains practically without influence in the low-pass channel. The limiters 9*a* through 9*n*, finally, are to be set in a known manner such that the discomfort threshold of the patient is not noticeably transgressed by the signal level at any frequency. When the filters 10*a* through 10*n* are built in, then they are to be dimensioned in such manner that distortion components are suppressed to the highest possible degree (for example, in that, in terms of frequency response, they are executed as duplicates of the corresponding channel separation filters 4*a* through 4*n*).

When the programming circuit 14 represents a microcomputer circuit functioning in the manner of an adaptive optimum filter, then this will only retain the above-described basic setting when, according to methods which are disclosed in the U.S. Pat. No. 4,025,721, only speech but no significant noise signal components are detected in the input signal supplied over the line 22. When, however, spurious noise components are perceived, then, in the sense of the optimum filter function, the gain in each channel automatically is decreased all the more the greater the ratio of the noise level to the speech signal level is in the appertaining channel.

The data which are supplied over the plug-type connection 21 to the programming circuit 14 can be tapped from an external device, for example an audiometer. To that end, it is necessary that the transmit part of a data interface is built into the external device, whereby the programming circuit 14 is executed in such a manner that it fulfills the function of the appertaining receive part. The data transmission from the external device to the hearing aid can ensue in accord with the signal plan of a standardized interface (for example CCITT-V.24 according to EIA RS 232); it is only the signal levels which are to be matched to the operating voltage of the hearing aid. After the transmission, a declared data word or control signal initiates a non-volatile storage in an EPROM or EAROM. A later re-programming is easily possible in that the non-volatile memory (EPROM or EAROM) is erased in accord with its structure (by means of ultraviolet radiation or electrical voltages) and a new data set is transmitted.

It will be apparent that many modifications and variations may be made without departing from the scope of the teachings and concepts of the present invention.

I claim as my invention:

1. A hearing aid device for the compensation of hearing deficiencies, said device comprising a signal input transducer for receiving input audio signals, an input amplifier connected at its input side with the output side of said input transducer, and an output transducer for supplying output signals compensated for a hearing deficiency of a hearing impaired individual, a plurality of parallel signal channels for transmitting respective signal components of an input signal, first bandpass filters connected at their input sides with the output side of said input amplifier and connected at their respective output sides with the respective parallel signal channels, said first bandpass filters having respective different frequency responses and supplying to the respective parallel signal channels respective signal components having respective different frequency bands of an input signal, and said first bandpass filters each being a sampled-data analog filter and being realized in integrated circuit technology, non-linear signal processing means in the respective parallel signal channels and connected at their respective input sides with the output sides of the respective first bandpass filters for non-linear processing of respective signal components with the respective different frequency bands, controlled-gain amplifiers in the respective parallel signal channels and having a volume control potentiometer which is common to all of said controlled gain amplifiers, said volume control potentiometer providing a common adjustment of the gain for all of said parallel signal channels, second bandpass filters in each of said parallel signal channels and connected at their input sides with the output sides of the respective non-linear signal processing means in the respective parallel signal channels, said second bandpass filters each being a sampled-data analog filter and being realized in integrated circuit technology, and said second bandpass filters having respective frequency responses substantially corresponding with the frequency responses of said first bandpass filters for reducing distortion components caused by the respective nonlinear signal processing means, and signal summing and amplifier means connected at its input side with the output sides of all of said second bandpass filters and connected at its output side with the input side of said output transducer for combining signal components from all of the second bandpass filters into a resultant signal and for supplying an amplified resultant signal to said output transducer.

2. A hearing aid device according to claim 1, wherein the number of said parallel signal channels lies between two and the maximum number of critical bands of hearing.

3. A hearing aid device according to claim 1 wherein the input amplifier has an upper cut-off frequency, the bandpass filters being operated with a clock frequency higher than the sun of the upper limit of hearing ability and the upper cut-off frequency of the input amplifier.

4. A hearing aid device according to claim 1 wherein said non-linear signal processing means comprise an individually programmed control circuit in each of said parallel signal channels for individually reducing the dynamic range of signal amplitudes in the respective frequency bands.

5. A hearing aid device according to claim 1 wherein each of said first and second bandpass filters and each of said non-linear signal processing means have respective individual control inputs for receiving individual control signals for setting the parameters thereof, a programming circuit having output means connected with the individual control inputs of each of said first and second bandpass filters and each of said non-linear signal processing means for the adjustment of the parameters according to the hearing inpairment of a given individual.

6. A hearing aid device according to claim 1, wherein said first and second bandpass filters in each of said parallel signal channels are realized as switched-capacitor filters.

7. A hearing aid device according to claim 1, wherein said signal input transducer comprises a microphone, said input amplifier having a low pass frequency response, the number of said parallel signal channels being in the range from two to twenty-four, said output transducer being an earphone, said non-linear signal processing means comprising an individually programmed control circuit in each of said parallel signal channels for individually reducing the dynamic range of signal amplitudes in the respective frequency bands, and individually programmed peak clipping circuits in the respective parallel signal channels for individually limiting the range of output signal amplitudes in the respective frequency bands.

8. A hearing aid device according to claim 1, wherein a microcomputer circuit realized in integrated circuit technology is connected with each of said first and second bandpass filters and with each of said non-linear signal processing means for individually adjusting the parameters thereof according to the hearing impairment of a given individual.

9. A hearing aid device according to claim 8, wherein the microcomputer circuit has an input connected to sense in input signal being supplied to said parallel signal channels so that the parameters of said non-linear signal processing means in each of said parallel signal channels can be adjusted in dependence on the input signal.

* * * * *